US007702118B2

(12) United States Patent
Park et al.

(10) Patent No.: US 7,702,118 B2
(45) Date of Patent: Apr. 20, 2010

(54) ELECTRET CONDENSER MICROPHONE FOR NOISE ISOLATION AND ELECTROSTATIC DISCHARGE PROTECTION

(75) Inventors: Book Sung Park, Seoul (KR); Jin Man Jang, Seoul (KR); Kwang Yeong Park, Anyang-Si (KR); Seung Hun Paek, Seongnam-Si (KR)

(73) Assignee: Pantech & Curitel Communications, Inc., Seoul (KR)

( * ) Notice: Subject to any disclaimer, the term of this patent is extended or adjusted under 35 U.S.C. 154(b) by 1447 days.

(21) Appl. No.: 11/072,912

(22) Filed: Mar. 4, 2005

(65) Prior Publication Data

US 2005/0196010 A1 Sep. 8, 2005

(30) Foreign Application Priority Data

Mar. 4, 2004 (KR) ..... 10-2004-0014527

(51) Int. Cl.
*H04R 3/00* (2006.01)
*H04R 5/00* (2006.01)

(52) U.S. Cl. ..... 381/113; 381/111; 381/112; 381/28

(58) Field of Classification Search ..... 381/386, 381/394, 396, 111–114, 122, 28; 330/207, 330/298

See application file for complete search history.

(56) References Cited

U.S. PATENT DOCUMENTS 5,640,127 A * 6/1997 Metz ..... 330/298
6,708,023 B1 * 3/2004 Pincenti et al. ..... 455/222
6,928,174 B1 * 8/2005 Mantysalo et al. ..... 381/113
2005/0089180 A1 * 4/2005 Saeki et al. ..... 381/174

FOREIGN PATENT DOCUMENTS

| | | |
|---|---|---|
| CN | 1416662 | 5/2003 |
| EP | 1473966 A1 | 11/2004 |
| JP | 2003-230195 | 8/2003 |
| JP | 2003230195 | 8/2003 |
| KR | 200319753 | 7/2003 |
| WO | 01-67811 | 9/2001 |
| WO | 03-067924 | 8/2003 |

OTHER PUBLICATIONS

European Search Report dated Jun. 16, 2008.

* cited by examiner

*Primary Examiner*—Xu Mei
*Assistant Examiner*—George C Monikang
(74) *Attorney, Agent, or Firm*—H.C. Park & Associates, PLC

(57) ABSTRACT

Disclosed is an electret condenser microphone which reinforces electrostatic discharge protection and noise isolation by adding a series of components in the electret condenser microphone.

According to the present invention, it is possible to block TDMA noise by embodying an RC circuit using series resistors and a varistor having a capacitor component in an electret condenser microphone, and to provide ESD protection effect when testing air or contact ESD by mounting two transient voltage suppressor (TVS) diodes. It is possible to block RF noises in various frequency bands, and to reduce TDMA noise level when making a call with a maximum power level, by applying an electret condenser microphone for ESD protection and noise isolation to a mobile communication terminal.

Further, since the electret condenser microphone according to the invention uses an internal analog ground, an artwork of a PCB substrate or isolations from other parts is possible.

12 Claims, 11 Drawing Sheets

(The Related Art)

(The Related Art)

FIG. 12A
(The Related Art)
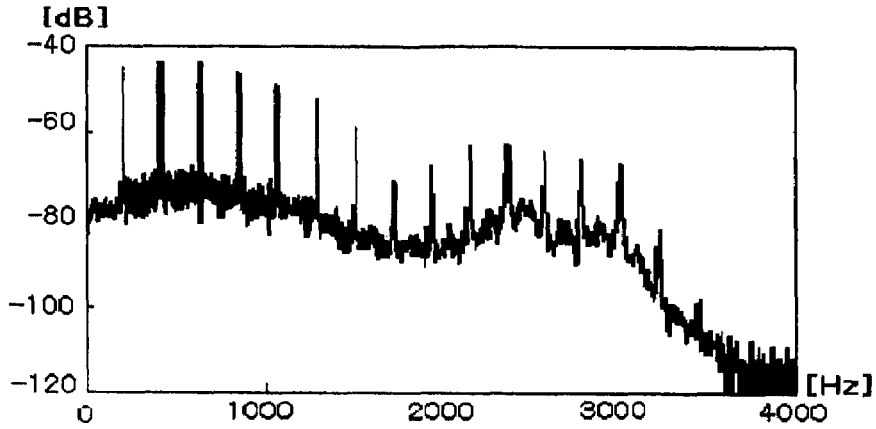
FIG. 12B
(The Related Art)
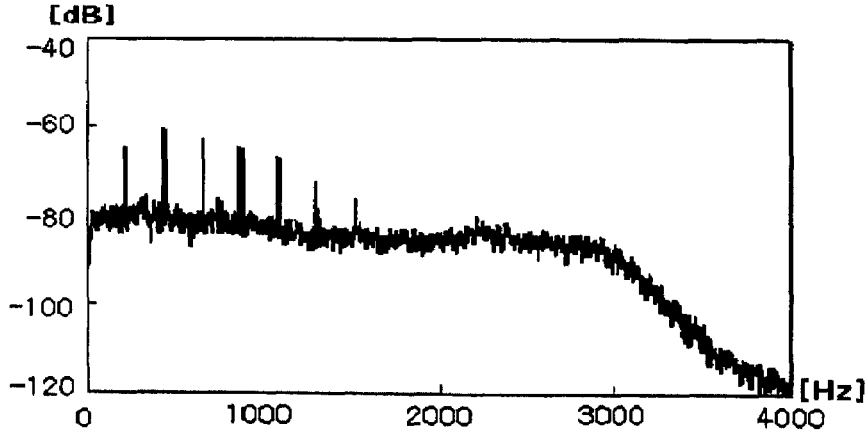
FIG. 12C
(The Related Art)
| | DCS mode | | GSM mode | |
|---|---|---|---|---|
| | Freq.(Hz) | Amp.(dB) | Freq.(Hz) | Amp.(dB) |
| 1Peak | 217.5 | -44.89 | 217.5 | -64.61 |
| 2Peak | 432.5 | -43.02 | 432.5 | -60.53 |
| 3Peak | 650.0 | -43.41 | 650.0 | -62.95 |

FIG. 12D
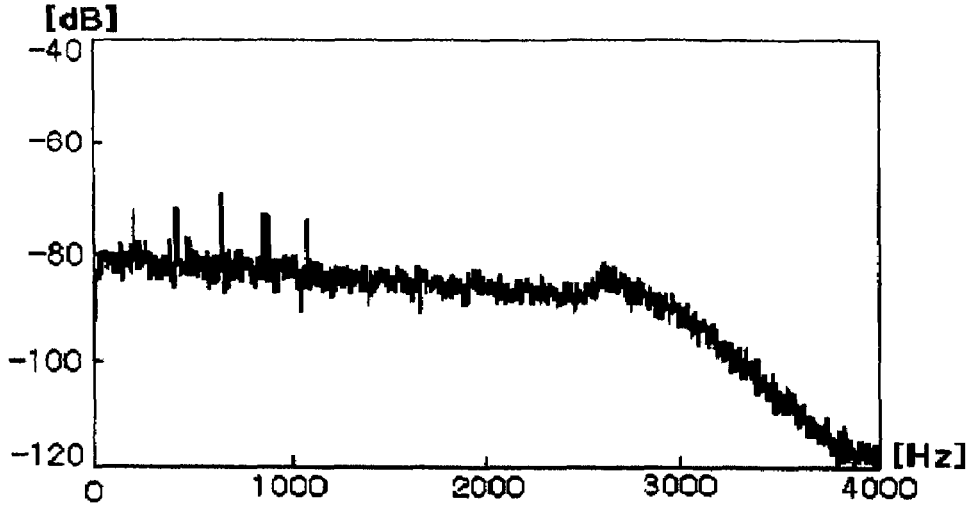
FIG. 12E
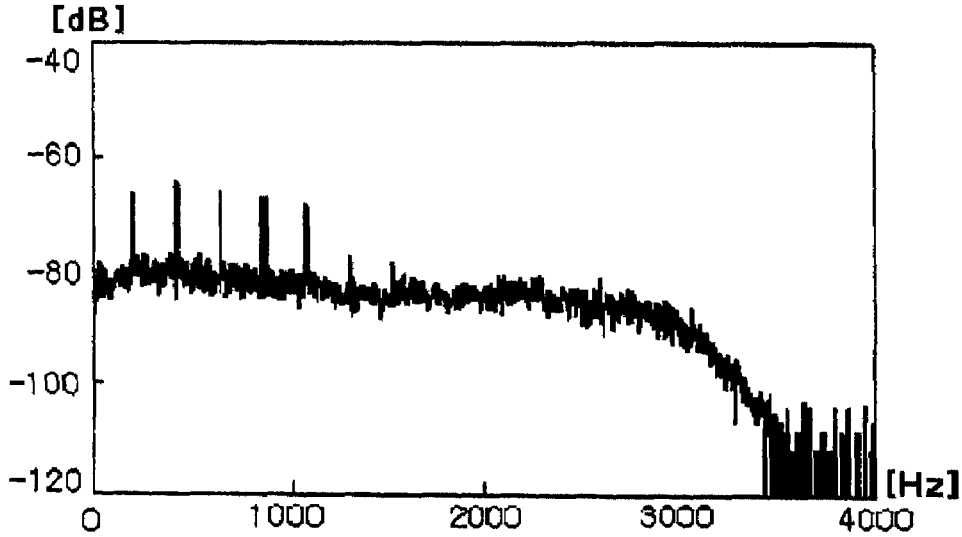
FIG. 12F
| | DCS mode | | GSM mode | |
|---|---|---|---|---|
| | Freq.(Hz) | Amp.(dB) | Freq.(Hz) | Amp.(dB) |
| 1Peak | 217.5 | -71.86 | 217.5 | -66.40 |
| 2Peak | 432.5 | -71.56 | 432.5 | -64.17 |
| 3Peak | 650.0 | -69.07 | 650.0 | -65.82 |

ELECTRET CONDENSER MICROPHONE FOR NOISE ISOLATION AND ELECTROSTATIC DISCHARGE PROTECTION

CROSS-REFERENCE TO RELATED APPLICATION

The present application is claiming priority of Korean Patent Application No. 10-2004-0014527, filed on Mar. 4, 2004, the content of which is incorporated herein by reference.

BACKGROUND OF THE INVENTION

1. Field of the Invention

The present invention relates to a condenser microphone used in a mobile communication terminal. More particularly, the present invention relates to an electret condenser microphone which reinforces electrostatic discharge protection and noise isolation by adding a series of components in the electret condenser microphone.

2. Description of the Related Art

Generally, in a condenser microphone used in a mobile communication terminal such as a smart phone, a PDA, a CDMA terminal and a GSM terminal, etc., sounds are received depending on quantity of electric charge varied according to a sound pressure and provided to a baseband codec through a Field-Effect Transistor (FET) as a differential type (which is one having both a positive terminal and a negative terminal).

However, in the above-mentioned condenser microphone, an external body is formed as a terminal of the differential, not a ground. Accordingly, when connecting to a device of the mobile communication terminal, noise flows in an input of the microphone due to a contact of a power supply line and a ground source.

In addition, as shown in FIG. 1, according to the related art condenser microphone, since only a Multi Layer Ceramic Capacity (MLCC) 11, which is a chip capacitor, and a FET 12 are provided on an internal PCB substrate 10, electrostatic discharge (ESD) protection is also poor.

BRIEF SUMMARY OF THE INVENTION

Accordingly, the present invention has been made to solve the above-mentioned problems occurring in the related art. The object of the present invention is to block TDMA noise by embodying an RC circuit using series resistors and a varistor having a capacitor component in an electret condenser microphone, and to provide ESD protection effect when testing air or contact ESD by mounting two transient voltage suppressor (TVS) diodes.

Other object of the present invention is to block RF noises in GSM, DCS and PCS frequency bands, and to reduce TDMA noise level when making a call with a maximum power level, by applying an electret condenser microphone for ESD protection and noise isolation to a mobile communication terminal.

In order to accomplish the objects, there is provided an electret condenser microphone used in a mobile communication terminal comprising: an amplifying unit for performing impedance matching with an external circuit; a chip capacitor arranged parallel to the amplifying unit, each terminal of the chip capacitor being electrically connected to the amplifying unit; a noise eliminator unit, comprising a varistor having a capacitor component and series resistors connected to the chip capacitor, for performing a noise isolation function, each of the resistors being respectively connected to each terminal of the chip capacitor; and an electrostatic discharge (ESD) protection unit, connected to output port of the condenser microphone, for performing ESD protection function.

Differently, in order to achieve the above objects, there is provided an electret condenser microphone for noise isolation and electrostatic discharge protection comprising: a field effect transistor (FET), mounted on a printed circuit board (PCB) substrate, for impedance matching with an external circuit; a chip capacitor connected to the FET, terminals of the chip capacitor being connected to a drain terminal and a source terminal of the FET respectively; an RC circuit, comprising a varistor having a capacitor component and series resistors connected to the chip capacitor, for performing a time division multiple access (TDMA) noise isolation function; and two transient voltage suppressor (TVS) diodes connected to output port of the condenser microphone, for performing ESD protection function.

Preferably, the RC circuit may be embodied by connecting each of the series resistors to each terminal of the chip capacitor respectively, and connecting each of the series resistors to each terminal of the varistor respectively.

Preferably, the two TVS diodes may be connected each other in symmetrical arrangement structure and cathode ports of the two TVS diodes are common ground, the two TVS diodes being connected parallel to the varistor.

Preferably, an analog ground may be embodied in the condenser microphone by connecting a point between the two TVS diodes and an outer case of the condenser microphone.

Preferably, the outer case of the condenser microphone may be a case coated with gold for reinforcing a ground function.

BRIEF DESCRIPTION OF THE DRAWINGS

The above and other objects, features and advantages of the present invention will be more apparent from the following detailed description taken in conjunction with the accompanying drawings, in which:

FIG. 12A, FIG. 12B and FIG. 12C show gain characteristics obtained when a maximum transmission power level is used in the prior electret condenser microphone; and FIG. 12D, FIG. 12E and FIG. 12F show gain characteristics obtained when a maximum transmission power level is used in an electret condenser microphone according to an embodiment of the present invention.

DETAILED DESCRIPTION OF THE PREFERRED EMBODIMENTS

Hereinafter, preferred embodiments of the present invention will be described with reference to the accompanying drawings. In the following description of the present invention, a detailed description of known functions and configurations incorporated herein will be omitted when it may make the subject matter of the present invention rather unclear.

Figure 1A:
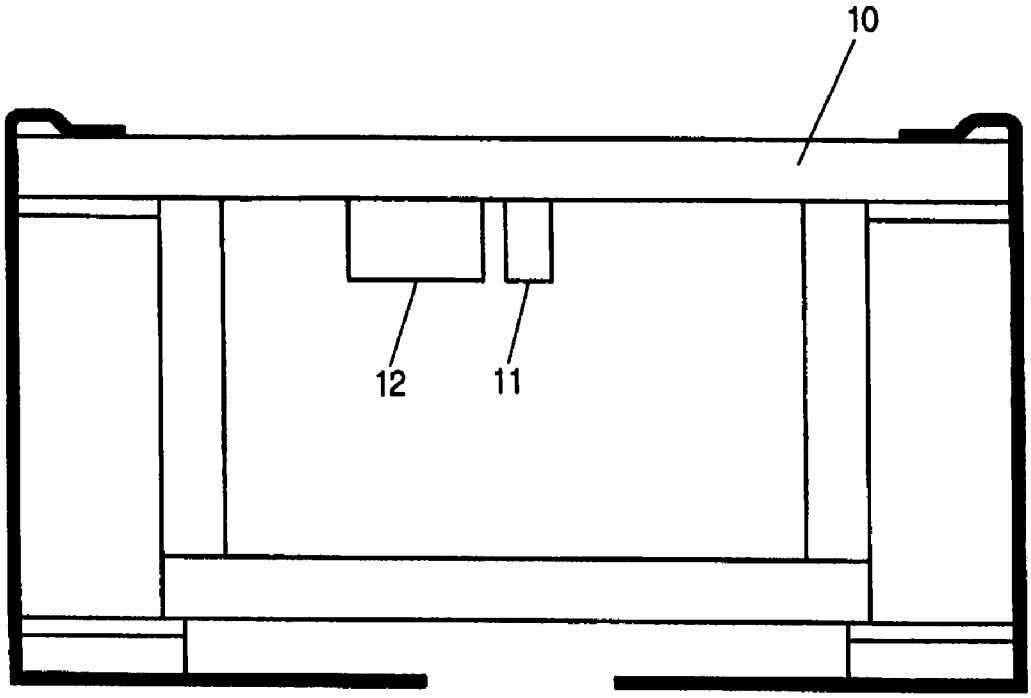
FIG. 1A and FIG. 1B are views schematically showing structure of a condenser microphone according to the related art.
Figure 1B:
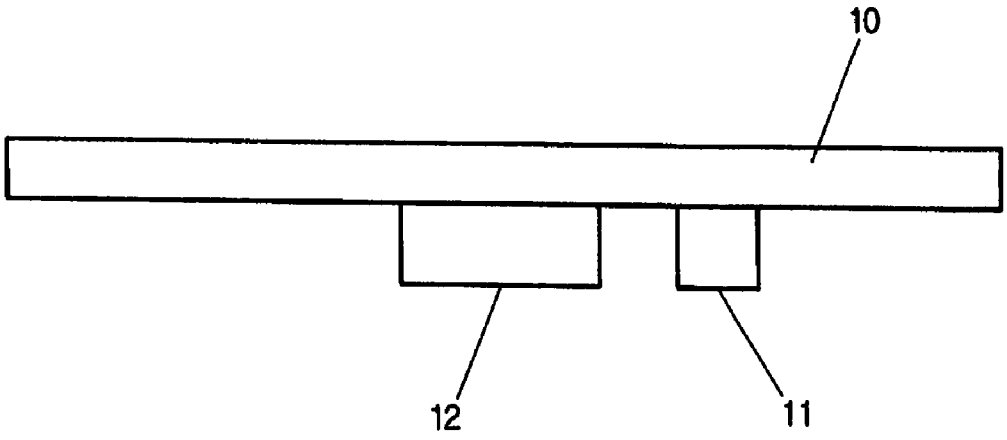
Figure 2A:
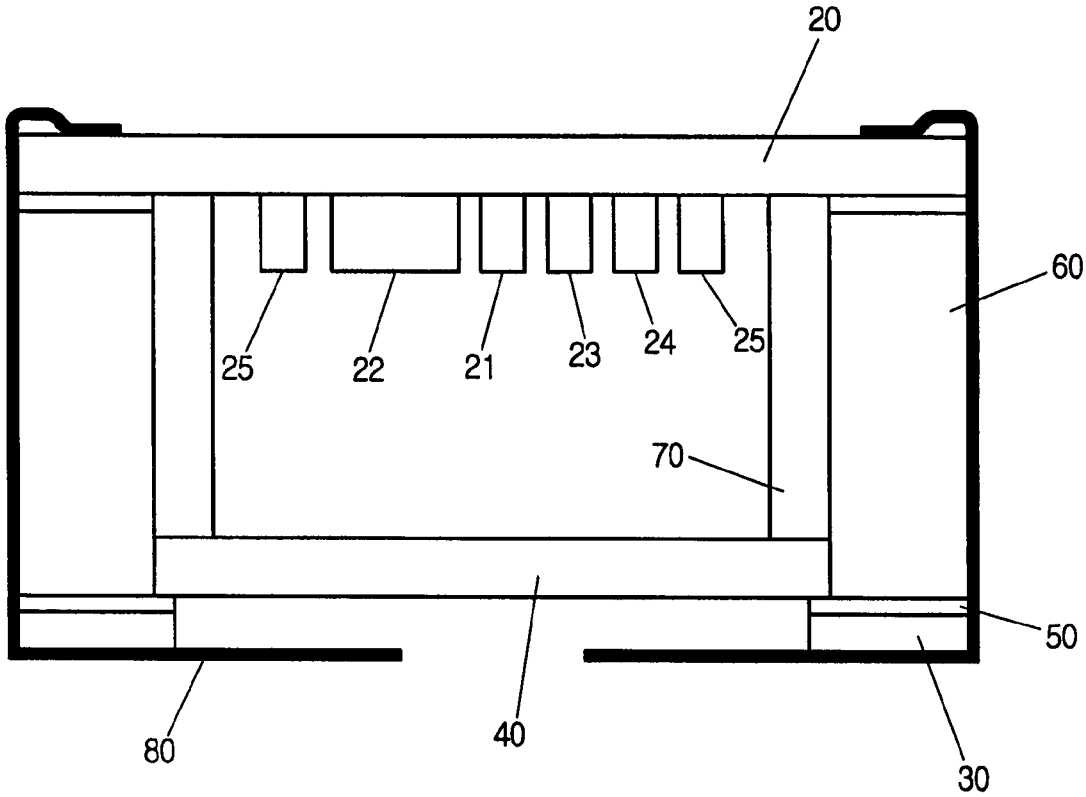
FIG. 2A and FIG. 2B show an electret condenser microphone used in a mobile communication terminal according to an embodiment of the present invention.

As shown in FIG. 2A, an electret condenser microphone used in a mobile communication terminal according to an embodiment of the present invention includes a diaphragm 30 serving as a vibrating plate vibrating according to a sound pressure, a back-electret 40 for forming an electrostatic field by forming an electrode, a spacer 50, which may be a polymer polyester (PET) film, for forming a space allowing an electrostatic field between the diaphragm 30 and the back-electret 40 to be formed, and a FET (which has an internal resistance of a 100 MΩ) 22 used for signal transmission when a signal occurs.

Figure 2B:
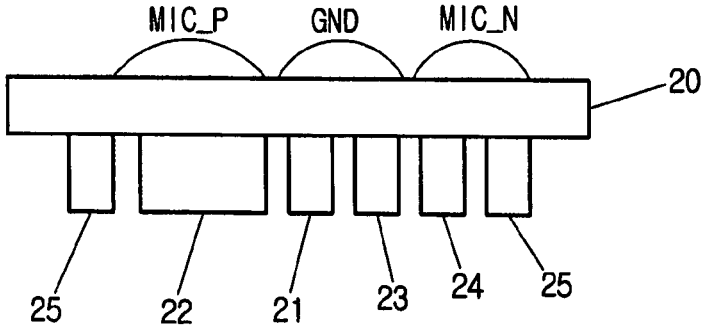
Figure 3:
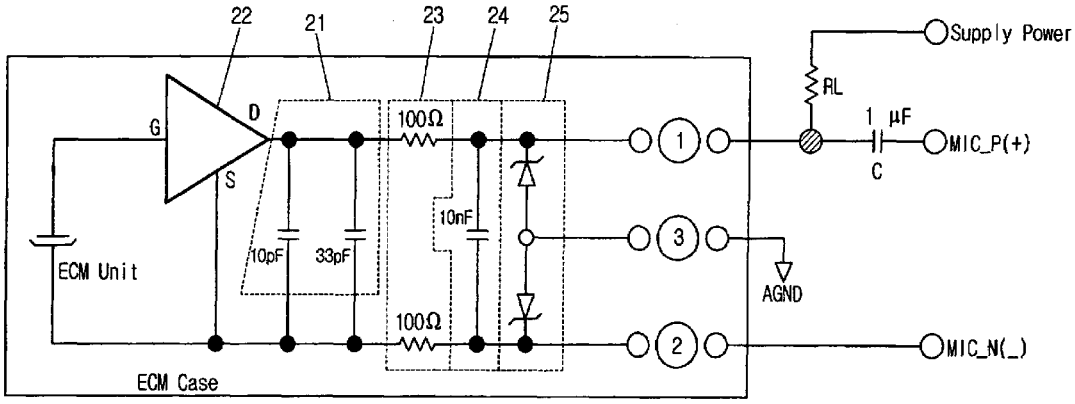
FIG. 3 is an internal circuit diagram of an electret condenser microphone according to an embodiment of the present invention.

As shown in FIG. 2B and FIG. 3, in addition to an MLCC 21 and the FET 22, an RC circuit including series resistors 23 and a varistor 24 having a capacitor component is added to a PCB substrate 20 in the electret condenser microphone, and two TVS diodes 25 are provided to an output of the microphone so as to improve an ESD protection function.

Figure 4A:
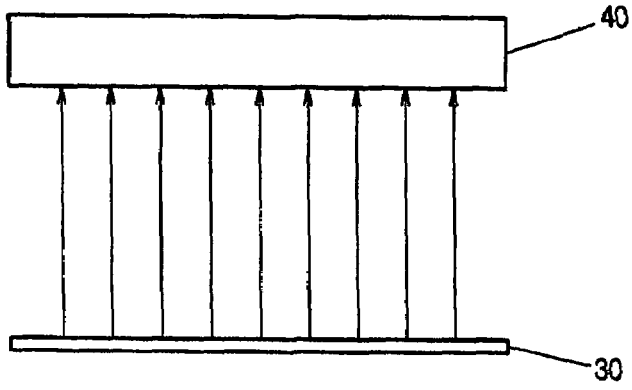
FIG. 4A, FIG. 4B and FIG. 4C are views to illustrate electrostatic capacity and charge between a back-electret and a diaphragm in an electret condenser microphone according to an embodiment of the present invention.

In addition, as shown in FIG. 4A, the electret condenser microphone is a kind of converters in which a sound signal is converted into an electric signal by variations of electrostatic capacity formed by the back-electret 40 and the diaphragm 30, and quantity of electric charge between the diaphragm 30 and the back-electret 40 is constant according to a principal using a relationship of 'Q=CV (Q: electric charge, C: electrostatic capacity, V: voltage)'.

Figure 4B:
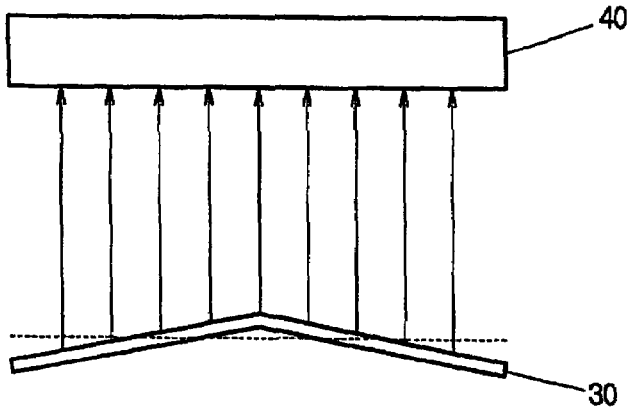
Figure 4C:
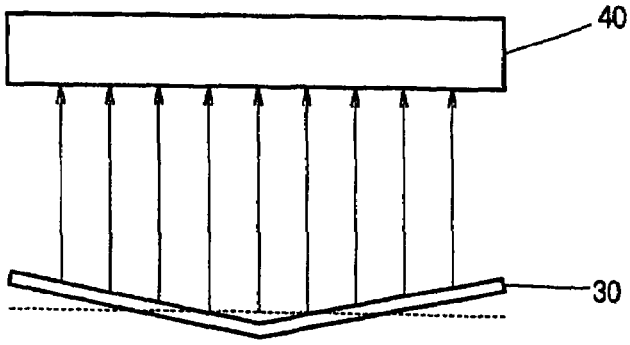

At this time, as shown in FIG. 4B and FIG. 4C, when the diaphragm 40 vibrates, the electrostatic capacity is varied. However, since an intensity of the electrostatic field and the quantity of electric charge formed between the diaphragm 30 and the back-electret 40 are constant, a value of voltage is varied as much as variation of the electrostatic capacity.

In other words, when the diaphragm 30 comes close to the back-electret 40, the electrostatic capacity increases (Q(constant)=C↑V↓), and when the diaphragm 30 becomes more distant, the electrostatic capacity decreases (Q(constant) =C↓V↑).

Figure 5:
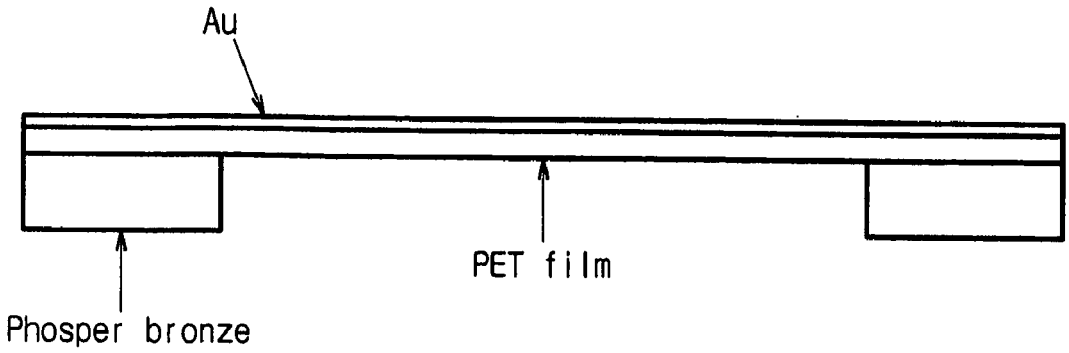
FIG. 5 is a detailed view of the diaphragm shown in FIG. 2.
Figure 6:
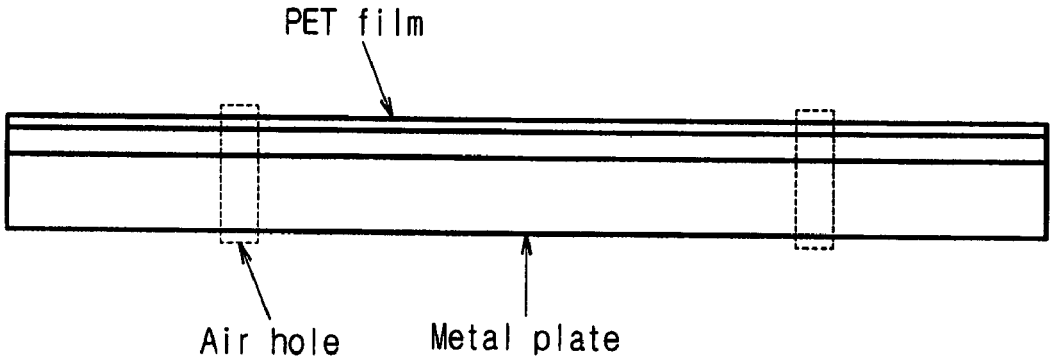
FIG. 6 is a detailed view of the back-electret shown in FIG. 2.

As a vibrating plate vibrating according to a sound pressure, the diaphragm 30 generates a voltage signal by regulating a value of the electrostatic capacity of the electrostatic field formed together with the back-electret 40. At the same time, the diaphragm 30 serves as an electrode forming the electrostatic field by forming an electrode together with the back-electret 40. For such a thing, as shown in FIG. 5, gold (Au) particles are coated on a surface of a PET film by using a sputtering technique.

The back-electret 40 is a component made to include a charge by laminating a polymer FET film (fluorinated ethylene propylene copolymer film) on a metal plate so that it can form a semi-permanent electrostatic field as well as an electrode together with the diaphragm 40, and has air holes on both sides of the metal plate so that the diaphragm 30 can vibrate. The back-electret 40 is a component of most exerting influence on sensitivity and reliability characteristics of the condenser microphone.

The spacer 50 forms a space allowing an electrostatic field to be formed between the diaphragm 30 and the back-electret 40. The polymer PET film is used as the spacer. A first base 60 is formed of a polymer material and serves to maintain structure of the condenser microphone, to fix the back-electret 40 and to prevent a signal voltage flowing via a case 80 and a second base 70 from being shorted.

The second base 70 is a component serving as a conducting line of transmitting an electric signal generated by the back-electret 40 and the diaphragm 30 to the PCB substrate 20, lowers an electric resistance by coating gold on brass, and contacts the back-electret 40 and the PCB substrate 20 in the first base 60.

The PCB substrate 20 forms a series of circuits, so that the PCB substrate transmits the electric signal transmitted by the second base 70 to a gate terminal of the FET 22. In addition, it forms '+' and '−' terminals, so that it connects a signal to an external terminal.

Figure 7:
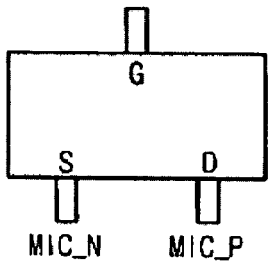
FIG. 7 is a detailed view of the connected state of FET shown in FIG. 2.

The FET 22 serves to match an impedance with an external circuit and thus to transmit a signal generated in the condenser microphone to a next terminal. Since the condenser microphone has an internal resistance of about 100 MΩ in generating a signal, the FET changes impedances so that an input impedance is high and an output impedance is low. As shown in FIG. 7, a drain terminal D is connected to a '+' terminal (MIC_P) of the microphone and a source terminal S is connected to a '−' terminal (MIC_N) of the microphone.

The case 80 forming an external shape of the condenser microphone is connected to the '−' terminal and thus serves as an analog ground (AGND). The case 80 is coated with gold so as to reinforce the ground function. In addition, it is subject to a curling process which is a last process of the microphone processes, so that it prevents sounds originated from the outside except a sound hall from infiltrating (when the external sound enters, it can cause a poor frequency).

The MLCC 21, which is a chip capacitor, is a component mounted on the PCB substrate 20 so as to block RF noise and connected to the source and drain terminals of the FET 22. A capacity of the chip capacitor, a series resonance filter, is determined depending on a frequency band of a mobile communication terminal. For example, a chip capacitor having capacity of 33 pF is used for a mobile communication terminal having a frequency band of 900 MHz, and a chip capacitor having capacity of 10 pF is used for the mobile communication terminal having a frequency band of 1.8 GHz.

Figure 8:
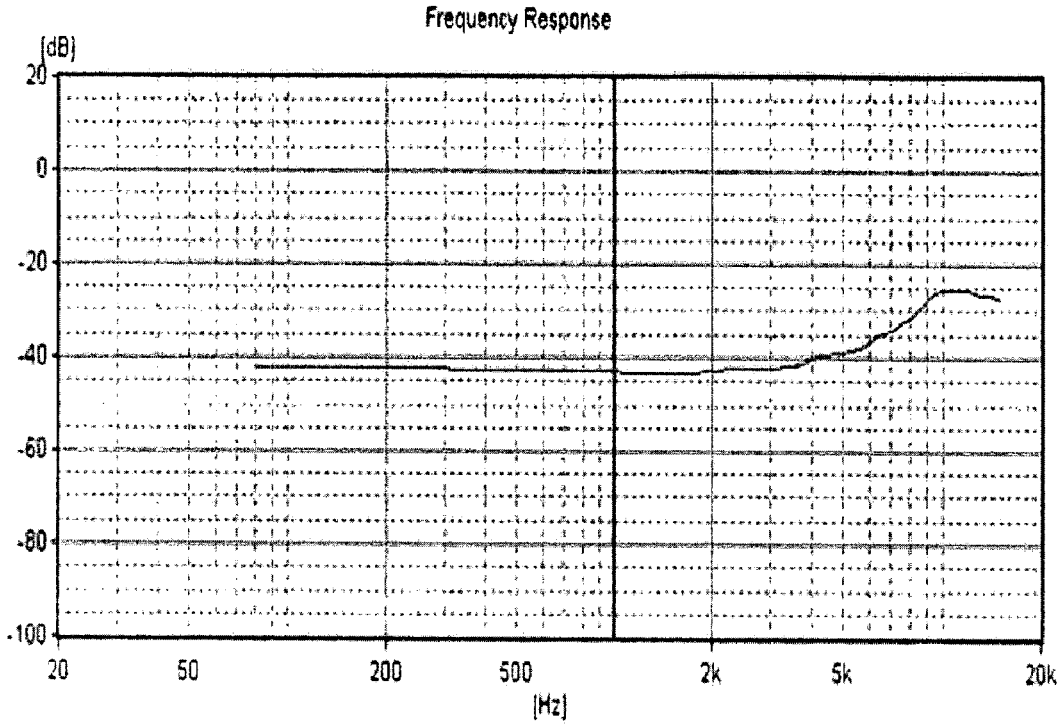
FIG. 8 is a graph showing a frequency response characteristic of an electret condenser microphone according to an embodiment of the present invention.
Figure 9:
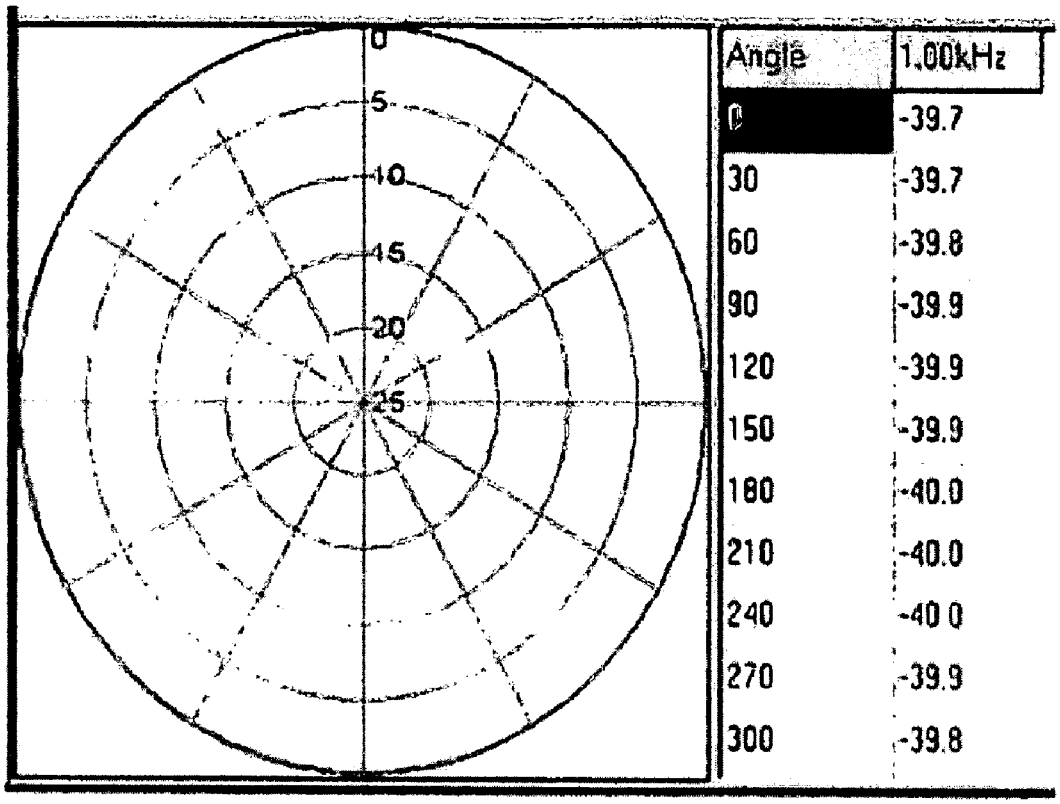
FIG. 9 is a graph showing a polar pattern of an electret condenser microphone according to an embodiment of the present invention.

As shown in FIG. 8, the electret condenser microphone (ECM) for ESD protection and TDMA noise isolation has a frequency response characteristic having gain of about −42 dB up to 3 kHz of frequency. Its polar pattern has a characteristic shown in FIG. 9. All of these exhibit characteristics of an omni-directional microphone.

Figure 10:
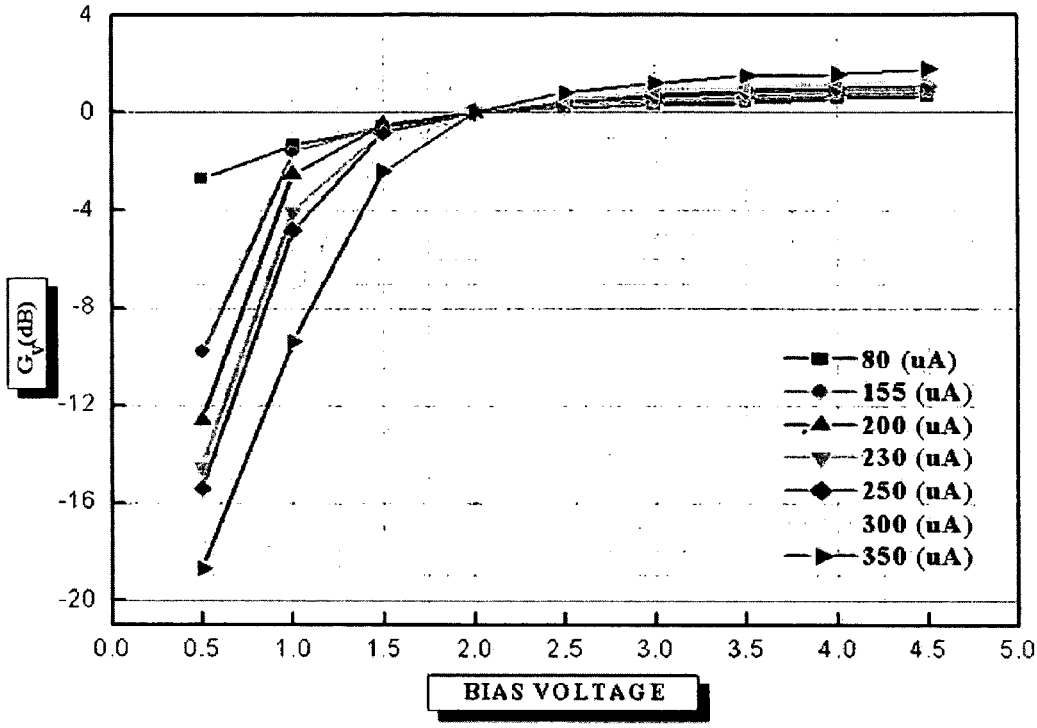
FIG. 10 is a graph showing a gain characteristic of the FET according to bias voltage and current consumption of an electret condenser microphone according to an embodiment of the present invention.
Figure 11:
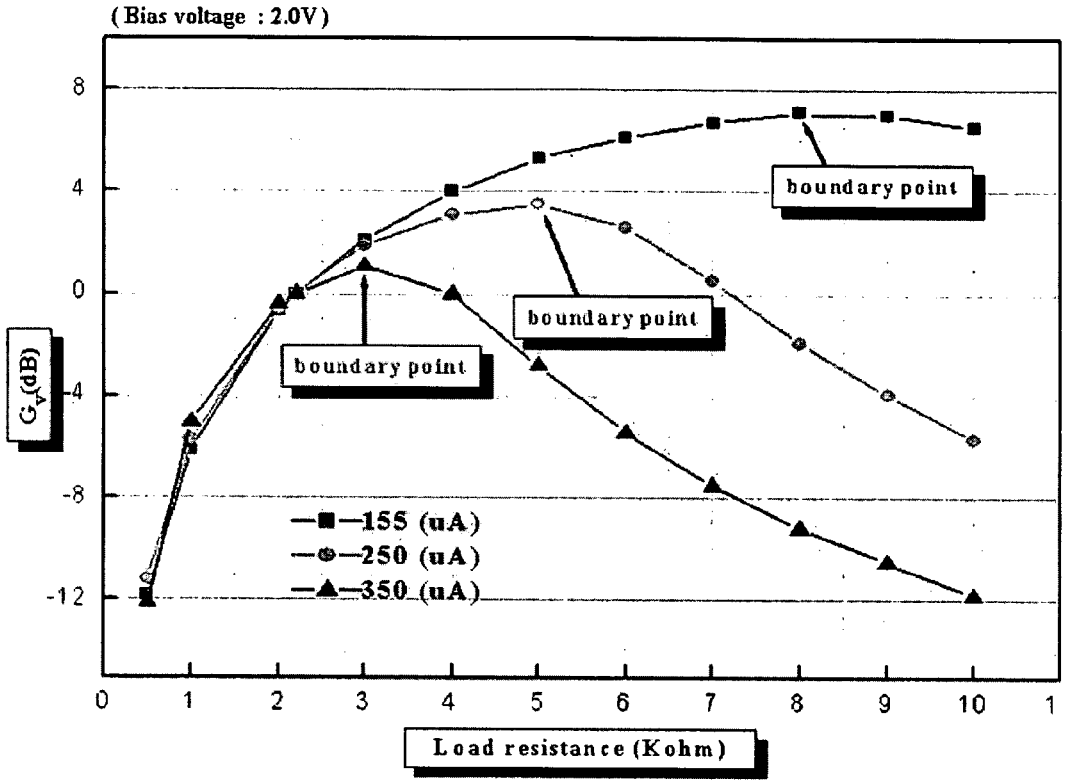
FIG. 11 is a graph showing a gain characteristic of the FET according to load resistance and current consumption of an electret condenser microphone according to an embodiment of the present invention.

FIG. 10 is a graph showing a gain characteristic of the FET according to bias voltage and current consumption, and FIG. 11 is a graph showing a gain characteristic of the FET according to load resistance and current consumption.

The ECM for ESD protection and TDMA noise isolation has a circuit shown in FIG. 3. In the ECM case 80, capacitors of 10 pF and 33 pF, which are the MLCC 21, are connected to the source terminal S and the drain terminal D of the FET 22 for blocking RF noises of GSM frequency band (1800 MHz or 900 MHz), DOS and POS frequency bands. In order to block TDMA noise when making a call with a maximum power level in GSM, DOS and POS frequency bands, the series resistor 23 and the varistor (10 nF) 24 having a shunt capacitor component are connected. The two TVS diodes 25 are connected to the output terminal so as to provide an ESD protection function when testing air or contact ESD.

According to the related art condenser microphone using a differential type, since an internal ground is not used and two pins of '+' and '−' terminals are inserted into an input of a baseband codec, an ESD protection device should be provided to an outside of the microphone. In addition, the ESD protection effect may not be provided even when a circuit is made in carrying out an artwork of a PCB substrate or line construction. However, according to the present invention, since the internal ground is provided in the condenser microphone and used as an analog ground (AGND), a line connected from the microphone to the codec is isolated, thereby providing an ESD protection effect.

In addition, gain characteristics obtained when using a maximum transmission power level in DCS and GSM frequency bands of the electret condenser microphone are shown in FIG. 12A to FIG. 12F. FIG. 12A to FIG. 12C show gain characteristics obtained when the related art electret condenser microphone is used, and FIG. 12D to 12F show gain characteristics obtained when the electret condenser microphone for ESD protection and TDMA noise isolation is used. FIG. 12A and FIG. 12D show gain characteristics in DCS frequency band, FIG. 12B and FIG. 12E show gain characteristics in GSM frequency band, and FIG. 12C and FIG. 12F are tables showing comparison results of DCS frequency band and GSM frequency band.

As described above, according to the present invention, an RC circuit using series resistors and a varistor having a capacitor component is further provided in the electret condenser microphone, so that it is possible to isolate TDMA noise. In addition, two TVS diodes are provided, so that it is possible to provide an ESD protection function when testing air or contact ESD.

Further, when the electret condenser microphone for ESD protection and noise isolation is applied to a mobile communication terminal, it is possible to block RF noises in GSM, DCS and PCS frequency bands, and to reduce a TDMA noise level when making a call with a maximum power level in the above mentioned frequency bands.

In addition, since the electret condenser microphone according to the present invention uses an internal analog ground, an artwork of a PCB substrate or isolations from other parts is possible.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An electret condenser microphone for noise isolation and electrostatic discharge protection, comprising:

an amplifying unit to perform impedance matching with an external circuit;

a chip capacitor arranged parallel to the amplifying unit, each terminal of the chip capacitor being electrically connected to the amplifying unit;

a noise eliminator unit, comprising a varistor having a capacitor component and series resistors connected to the chip capacitor, to perform a noise isolation function, each of the resistors being respectively connected to each terminal of the chip capacitor; and an electrostatic discharge (ESD) protection unit, connected to output port of the condenser microphone, to perform ESD protection function, the ESD protection unit comprising two transient voltage suppressor (TVS) diodes commonly connected at their cathodes to a ground.

2. An electret condenser microphone for noise isolation and electrostatic discharge protection, comprising:

a field effect transistor (FET), mounted on a printed circuit board (PCB) substrate, to perform impedance matching with an external circuit;

a chip capacitor connected to the FET, two terminals of the chip capacitor being connected to a drain terminal and a source terminal of the FET, respectively;

an RC circuit, comprising a varistor having a capacitor component and series resistors connected to the chip capacitor, to perform a time division multiple access (TDMA) noise isolation function; and two transient voltage suppressor (TVS) diodes connected to output port of the condenser microphone to perform an electrostatic discharge (ESD) protection function, the two TVS diodes being commonly connected at their cathodes to a ground.

3. The electret condenser microphone according to claim 2, wherein the RC circuit is embodied by connecting each of the series resistors to each terminal of the chip capacitor, respectively, and connecting each of the series resistors to each terminal of the varistor, respectively.

4. An electret condenser microphone, comprising:

a field effect transistor (FET), mounted on a printed circuit board (PCB) substrate, to perform impedance matching with an external circuit;

a chip capacitor connected to the FET, two terminals of the chip capacitor being connected to a drain terminal and a source terminal of the FET, respectively;

an RC circuit, comprising a varistor having a capacitor component and series resistors connected to the chip capacitor, to perform a time division multiple access (TDMA) noise isolation function; and two transient voltage suppressor (TVS) diodes connected to output port of the condenser microphone to perform an electrostatic discharge (ESD) protection function, wherein each series resistor is connected to each terminal of the chip capacitor, respectively, and each series resistor is connected to each terminal of the varistor, respectively, and wherein the two TVS diodes are connected each other in symmetrical arrangement structure and cathode ports of the two TVS diodes are common ground, the two TVS diodes being connected parallel to the varistor.

5. The electret condenser microphone according to claim 4, wherein an analog ground is embodied in the condenser microphone by connecting a point between the two TVS diodes and an outer case of the condenser microphone.

6. The electret condenser microphone according to claim 5, wherein the outer case of the condenser microphone is a case coated with gold for reinforcing a ground function.

7. The electret condenser microphone of claim 1, wherein the chip capacitor comprises a first capacitor having a first capacitance for a first frequency band according to a cellular telephone protocol, and a second capacitor having a second capacitance for a second frequency band according to a cellular telephone protocol.

8. The electret condenser microphone of claim 7, wherein the first capacitor and the second capacitor are arranged in parallel.

9. The electret condenser microphone of claim 2, wherein the chip capacitor comprises a first capacitor having a first capacitance for a first frequency band according to a cellular telephone protocol, and a second capacitor having a second capacitance for a second frequency band according to a cellular telephone protocol.

10. The electret condenser microphone of claim 9, wherein the first capacitor and the second capacitor are arranged in parallel.

11. The electret condenser microphone of claim 4, wherein the chip capacitor comprises a first capacitor having a first capacitance for a first frequency band according to a cellular telephone protocol, and a second capacitor having a second capacitance for a second frequency band according to a cellular telephone protocol.

12. The electret condenser microphone of claim 11, wherein the first capacitor and the second capacitor are arranged in parallel.

* * * * *